United States Patent [19]

Schwartz et al.

[11] 4,317,468

[45] Mar. 2, 1982

[54] PRESSURE RELIEF VALVE

[75] Inventors: Edwin L. Schwartz; Allen W. Langan, both of Los Angeles, Calif.

[73] Assignee: Rite Autotronics Corporation, Los Angeles, Calif.

[21] Appl. No.: 87,401

[22] Filed: Oct. 22, 1979

[51] Int. Cl.[3] ..... F16K 15/02

[52] U.S. Cl. ..... 137/540; 251/337

[58] Field of Search ..... 137/540, 542, 529; 251/337

[56] References Cited

U.S. PATENT DOCUMENTS

| | | | |
|---|---|---|---|
| 946,661 | 1/1910 | Desmond | 137/542 X |
| 1,346,921 | 7/1920 | Terry | 137/540 |
| 1,489,488 | 4/1924 | Erickson | 137/540 X |
| 2,619,982 | 12/1952 | Turnel | 137/542 X |
| 2,908,288 | 10/1959 | Carr et al. | 137/540 |

FOREIGN PATENT DOCUMENTS

| | | | |
|---|---|---|---|
| 59781 | 8/1938 | Sweden | 137/540 |

*Primary Examiner*—William R. Cline

*Attorney, Agent, or Firm*—John J. Posta, Jr.

[57] ABSTRACT

An air compressor having a main pressure line connected to an object to be inflated and an accumulator connected to the main pressure line through a restrictor to receive an average of the output pressure during the pumping stroke and to receive, at other times, the actual object pressure so that the pressure in the accumulator corresponds to the pressure in the object, and a relief valve responsive to the pressure in the accumulator for connecting the accumulation to atmosphere when a pressure preselected by a regulator is obtained in the object.

13 Claims, 10 Drawing Figures

Fig. 1
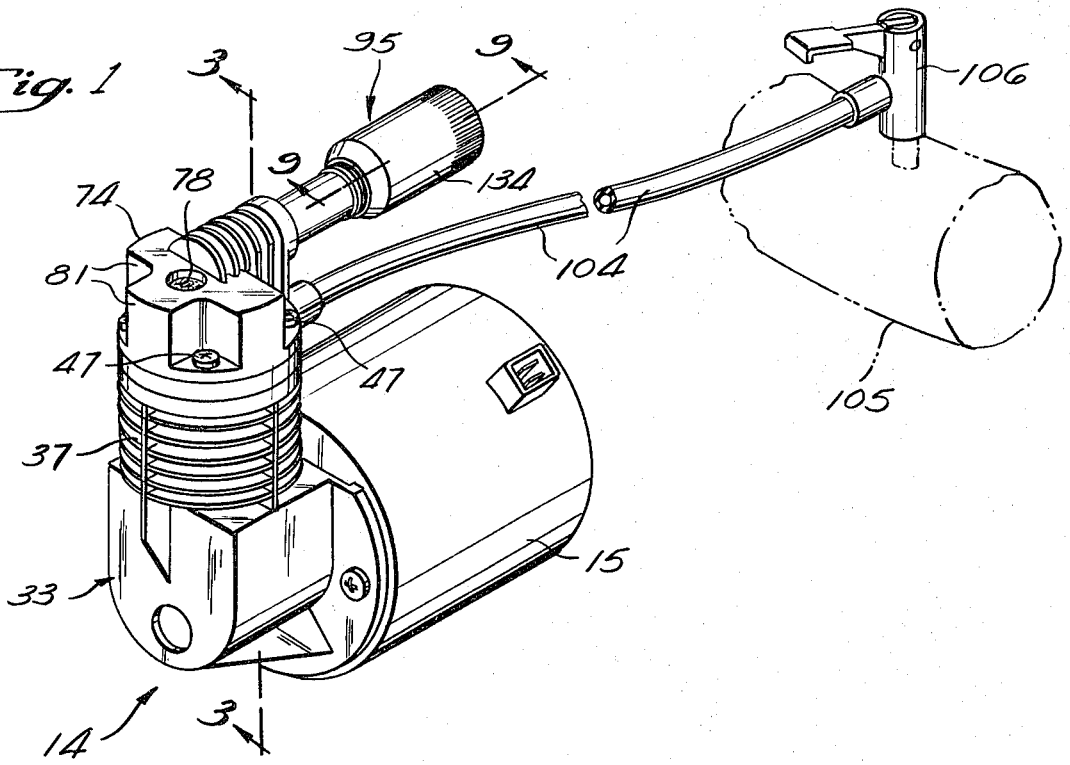
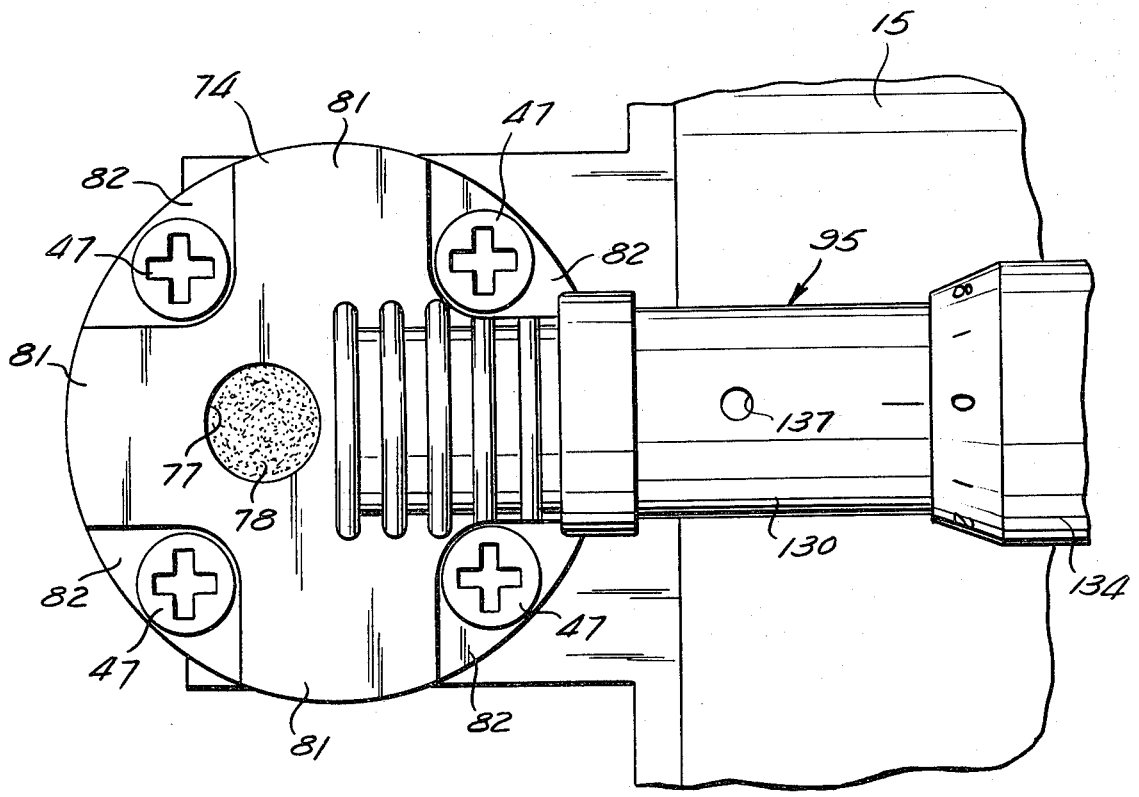
Fig. 2

Fig. 4
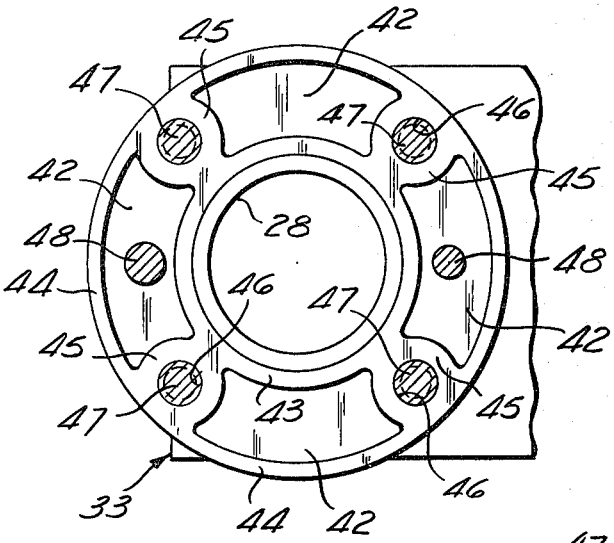
Fig. 5
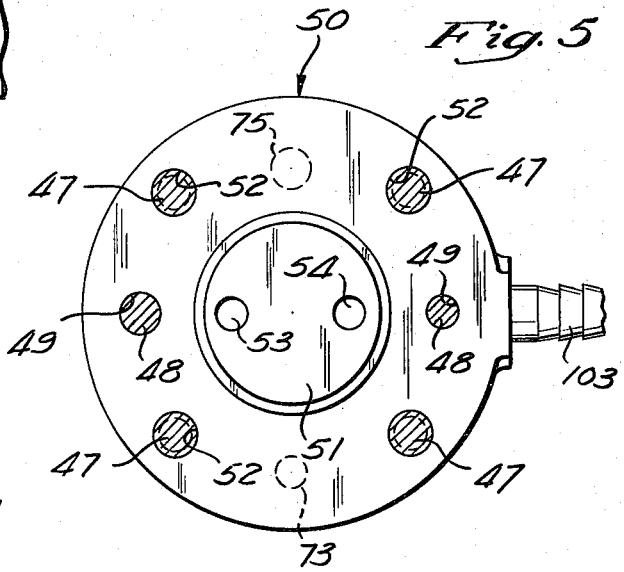
Fig. 7
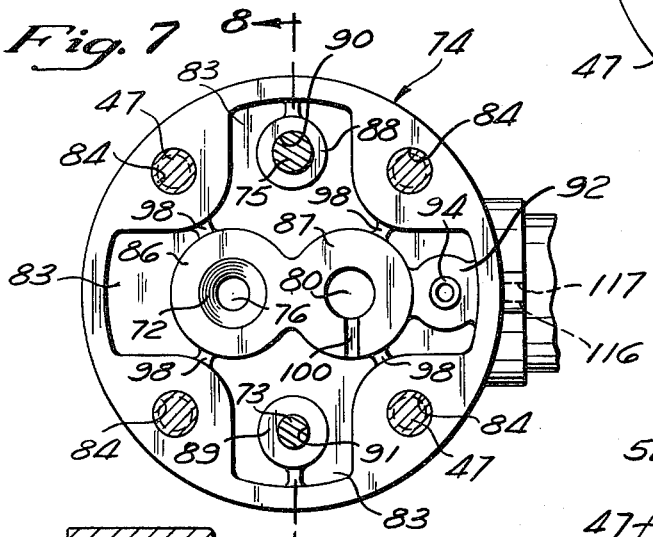
Fig. 6
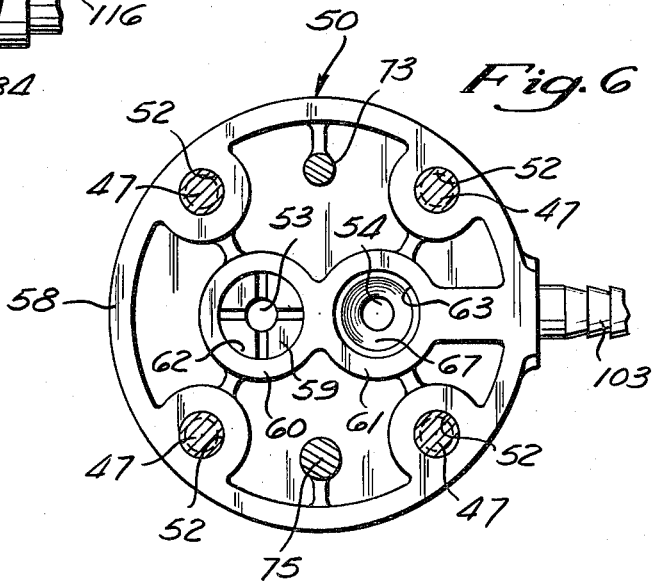
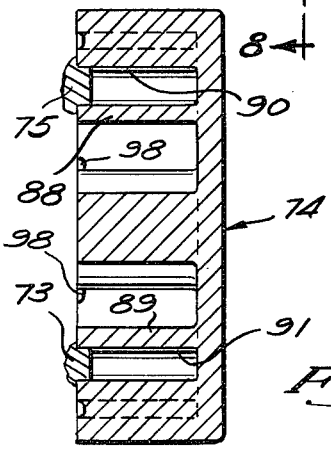
Fig. 8

Fig. 9
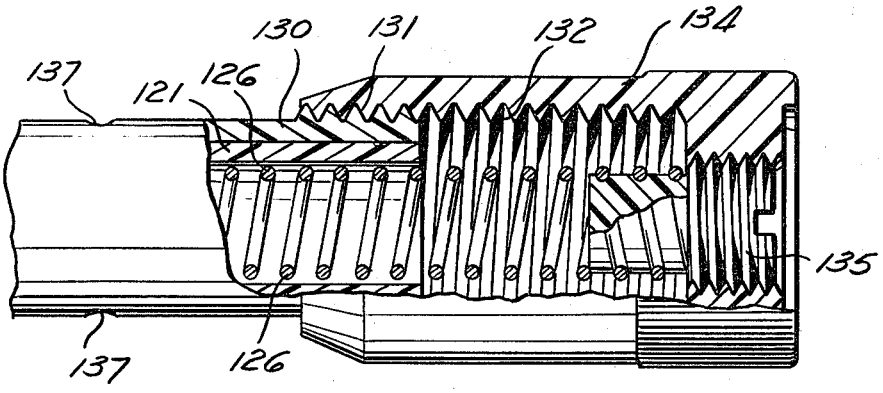
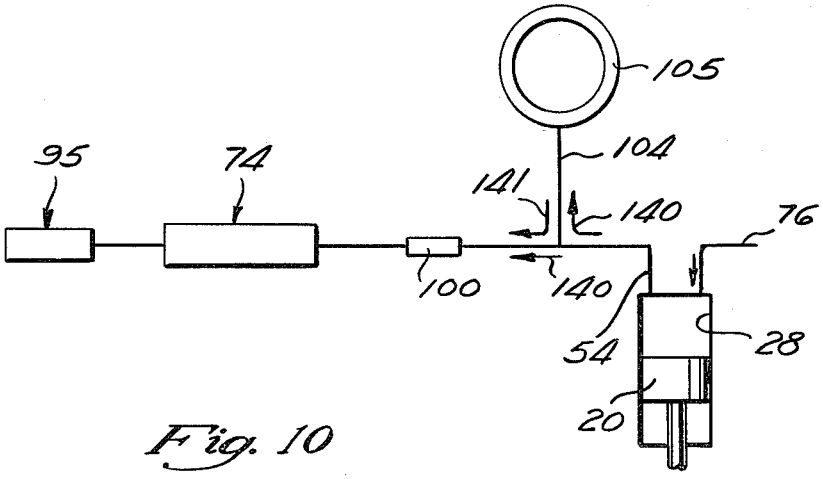
Fig. 10

PRESSURE RELIEF VALVE

BACKGROUND OF THE INVENTION

The field of this invention relates to a pump or compressor for producing air or gas under pressure to inflate an object, such as a vehicle tire. More particularly, the invention relates to an electrically driven air compressor preferably powered by the car battery. Compressed air has been produced by use of a hand or foot pump in which the air is pressured by physical strength. Such foot pumps are illustrated in U.S. Pat. No. 1,280,511 to Macbeth, dated Oct. 1, 1918, and U.S. Pat. No. 1,160,528 to Pilkington, dated Nov. 16, 1915, and in British Pat. No. 1,182,102, published Feb. 22, 1970. In these patents, the pressure of the air in the pressurized air line leading to the object is measured by a gauge connected to the air line. Also, as illustrated in U.S. Pat. No. 1,831,379 to Creser, dated Nov. 10, 1931 and British Pat. No. 296,915 accepted Sept. 13, 1928, a relief valve can be connected to the pressurized air line to bleed air from the line to atmosphere when the air reaches a predetermined selected valve.

Small electrically driven air compressors have also been utilized to inflate tires and other objects and can be provided with similar gauges or relief valves in the pressurized air line leading to the object to be inflated. However, since the gauges and relief valves of the prior art are located in the main pressurized air line leading to the inflatable object, these devices are subject to the pressure variations in the pressure line produced by the pump during each stroke and will not be responsive to the pressure in the object which is the important quantity. In pending application Ser. No. 946,665 filed Sept. 28, 1978, by Edwin L. Schwartz and assigned to the same assignee, there is disclosed devices which isolate the relief valve from pressure pulses which exceed the pressure in the inflatable object so that a false relief to atmosphere will not result before the inflatable object has reached the desired inflation pressure.

In previously mentioned U.S. Pat. No. 1,831,379, it is proposed to discharge all of the high pressure air produced by the compressor through a coiled pipe of fine bore in order to smooth out fluctuations in pressure. A standard relief valve is connected with the end of the coil which leads to the main pressure line and to the inflatable object. Therefore, the presssure sensed by the relief valve will always be the same as that in the main pressure line. Thus, the pumping load on the compressor is greatly increased since the complete air volume must pass through the fine bore coil and any pressure surges in the main line will act upon the relief valve.

SUMMARY OF THE INVENTION

The present invention provides an air compressor in which a small amount of pressurized air is bled from the main pressure line through a restrictor into an accumulator and the relief valve is in communication only with the accumulator. During the pressure stroke of the compressor, substantially all of the pressurized air passes directly to the object through the main feed line and a small portion only passes to the accumulator through the line restrictor. The pressure variation in the main feed line is averaged out by the restrictor so that the accumulator receives air at an average pressure without appreciable pulsations. During the intake stroke of the piston, the accumulator is connected to the pressure in the object through the restrictor. Since there are no appreciable variations of pressure in the object, the object pressure is imparted to the accumulator during the period of the intake stroke. Thus, by connecting the relief valve to the accumulator, it is isolated from pressure peaks in the main pressure line. The accumulator directly receives the pressure in the object during a period of the compressor operation and receives an average of the output pressure during the output stroke, which the average is about equal to the pressure in the object against which the compressor acts. Thus, pressure peaks will not open the relief valve.

By utilizing an accumulator which receives only a small portion of the compressor output, no resistance in the main line is placed on the compressor since the pressure pulses in the main line are delivered directly to the object. By connecting the relief valve to the accumulator, the relief valve will open only when the desired pressure is obtained in the object. Thus, the present invention eliminates the necessity of damping the entire pump output and avoids connecting the relief valve to the main pressure line where it is subject to pressure variations produced by the compressor. Since the volume of the accumulator is only several times the piston displacement, the accumulator of the present invention can be mounted directly above the compressor cylinder and can have substantially the same circumference as the cylinder. Only the regulator, which sets the pressure at which the relief valve opens, need extend beyond the circumference of the cylinder.

BRIEF DESCRIPTION OF THE DRAWINGS

FIG. 1 is a perspective view illustrating the air compressor and pressure regulator;

FIG. 2 is a partial top plan view of FIG. 1;

FIG. 4 is a sectional view along line 4—4 of FIG. 3 showing the top end of the cylinder;

FIG. 5 is a section along line 5—5 of FIG. 3 illustrating the bottom surface of the valve housing;

FIG. 6 is a section along line 6—6 of FIG. 3 showing the top surface of the valve housing with certain parts removed;

FIG. 7 is a section along line 7—7 of FIG. 3 showing the lower side of the accumulator;

FIG. 8 is a vertical section of the accumulator along line 8—8 of FIG. 7;

FIG. 9 is a partial transverse vertical section along line 9—9 of FIG. 1 of the regulator cap;

FIG. 10 is a schematic diagram of the invention showing the relationship between the restrictor, accumulator, relief valve and regulator.

DESCRIPTION OF THE PREFERRED EMBODIMENT

Figure 3:
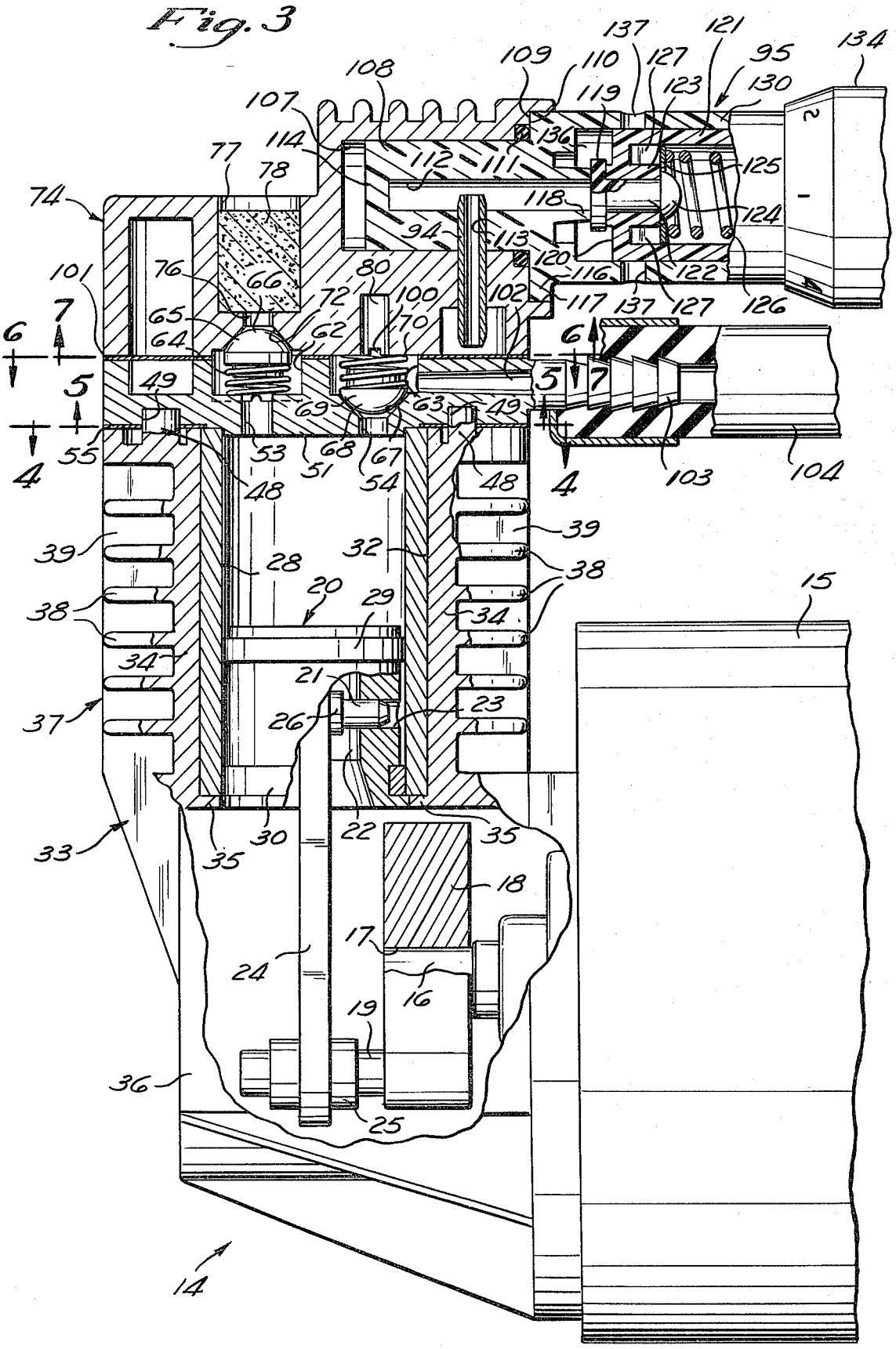
FIG. 3 is an enlarged, partial sectional view along line 3—3 of FIG. 1.

Referring to FIGS. 1 and 3, the air compressor 14 comprises direct current motor 15 having a drive shaft 16 press fitted into an irregular shaped opening 17 in weight 18. A crank pin 19 is attached to weight 18 at a position offset from shaft 16 by an amount one half the stroke of piston 20. A pin 21 extends through space 22 in the piston and has its opposite ends located in openings 23 in the piston. Connecting rod 24 has a bearing 25 receiving pin 19 and a bearing 26 receiving pin 21 so that piston 20 will reciprocate in cylinder 28 during rotation of shaft 16 by motor 15. The piston has a sealing ring 29 near its top end and a pressure ring 30 near its lower end. The cylinder 28 consists of a metal sleeve located in an opening 32 in the casing 33 and the casing has a wall 34 and shoulder 35 for accurately locating the sleeve. The casing has a cover portion 36 for the weight 18 and connecting rod 24 and a cooling portion 37 surrounding opening 32. The portion 37 consists of a plurality of cooling fins 38 attached to spaced upright members 39.

Referring to FIG. 4, the top surface of casing 33 has four depressed areas 42 between raised inner rim 43 and outer rim 44 and has four raised portions 45 containing openings 46 for mounting screws 47 (see FIG. 2). Also, two locating pins 48 project slightly above the rim to enter depressions 49 in the lower surface of valve housing 50 (see FIG. 5). The lower surface of the valve housing 50 also has a disc projection 51 which enters into the end of cylinder sleeve 28. Four openings 52 in valve housing 50 receive the four mounting screws 47 and two passages 53 and 54 are located in disc 51. A gasket 55 is located between the top surface of the casing 33 and the lower surface of the valve housing and has openings corresponding to disc 51, openings 52 and depressions 49.

The upper surface of valve housing 50 is illustrated in FIG. 6 and is surrounded by a raised rim 58 which extends around openings 52. Also, two raised cylinders 60 and 61 connect with passages 53 and 54, respectively, and form cavities 62 and 63 respectively. Cavity 62 has a flat bottom 59 for supporting the larger end of a light coil spring 64. The other end of spring 64 supports one end of a hard rubber valve 65 which has a dome shaped valve surface 66 on the opposite end. Cavity 63 has a tapered surface 67 which coacts with a dome shaped surface 68 on a rubber valve 69 supported at one end of light coil spring 70. The surface 66 of valve 65 coacts with a tapered surface 72 in the lower surface of accumulator 74 (See FIG. 7) to control inlet air passage 76 leading to atmosphere through cavity 77 containing air filter 78. Also, an end of spring 70 bears against the accumulator surface around cavity 80. Two locating pins 73 and 75 project upwardly from the surface of the valve housing 50.

As illustrated in FIG. 2, the accumulator 74 has raised portions 81 containing cavity spaces 83 and between the portions are low surfaces 82 which engage the heads of mounting screws 47 when the screws are inserted through openings 84. Centrally of the accumulator are two elevated cylinders 86 and 87. The cylinder 86 contains the tapered surface 72 and passage 76, previously mentioned, and the cylinder 87 contains the cavity 80. Another two cylindrical projections 88 and 89 contain cavities 90 and 91, respectively, for receiving the locating pins 73 and 75, respectively, previously described. Also, a lower cylindrical projection 92 occupies the space between the cylinder 87 and the edge of one of the raised portions and this projection receives a hollow pin 94 leading to the regulator 95. As is apparent from FIGS. 7 and 8, the cavities 83 are all interconnected since the webs 98 connected to cylinder 86 and 87 do not extend to the ends of the cylinders. Further, the interconnected cavity spaces 83 receive a small portion of the pressurized air produced by the piston in space 80 through the restrictor passage 100 in the end surface of cylinder 87. The pressure in the cavities 83 is communicated to the regulator through pin 94 (see FIG. 3). The adjacent surfaces of housing 50 and accumulator 74 engage a gasket 101 containing suitable openings.

As is apparent from FIG. 3, when the piston 20 moves downwardly on the suction stroke, the valve 65 is moved off its seat surface 72 and air is drawn into the cylinder 28. During this stroke, the suction pressure keeps the valve 69 closed. On the pressure stroke, the pressure closes the valve 65 and opens the valve 69. The valve housing contains a passage 102 connected with cavity 63 and with fitting 103 located exteriorly of the housing. A main pressure line 104 connects the fitting 103 with the object 105 by attachment means 106. Thus, substantially all of the air leaving cylinder 28 on the pressure stroke will flow through passages 54, 102 and 104 to the object and only a small portion will enter cavities 83 through restrictor passage 100. Also, during the suction stroke of the piston, valve 69 will be closed and the pressure in the object will communicate with cavities 83 through passage 102, cavities 83 and restrictor passage 100.

One of the raised portions 81 of accumulator 74 contains a cavity 107 having ridges on its surface and the end 108 of pressure regulator 95 is inserted into cavity 107. The end 108 has a shoulder 109 which engages a step 110 in the raised portion and a sealing ring 111 is located between these two surfaces to prevent leakage. A passage 112 is contained in end 108 and is closed at one end by end wall 114. The end 108 has a small projection 116 which enters a slot 117 in the housing 74 to locate the end 108 so that opening 113 in the end 108 will be in alignment with pin 94 and the pin can be driven into communication with passage 112. The other end of passage 112 terminates in a valve seat 118 which is normally closed by rubber relief valve 119 which is mounted on end wall 120 of spring housing 121 by means of a pin 122 pressed into a sleeve 123 projecting from end wall 120. The enlarged end 124 of pin 122 is surrounded by a steel ring 125 which is the seat for one end of spring 126. Radial flanges 127 around sleeve 123 aid in supporting ring 125.

The spring housing 121 can slide within cylindrical extension 130 connected with end 108 and the end of extension 130 has threads 131 to receive internal threads 132 on cylindrical cap 134. The spring 126 extends beyond the spring housing 121 and extension 130 and into the interior of cap 134. A plug 135 is threaded into an opening in the end of cap 134 and the other end of spring 126 is threaded onto the plug to secure the spring. By adjusting plug 135 axially, the force of spring 126 which holds the valve 119 against seat 118 can be varied for calibration purposes. Also, by rotation of cap 134 on extension 130, the force of the spring can be adjusted to select the object pressure which will move the relief valve 119 and housing 121. When the pressure in passage 112 reaches this selected pressure, it will move valve 119 off of seat 118 and the pressure in space 136 will then act against the larger area of end wall 120 to provide for quick movement of the housing against the spring. The extension 130 contains two openings 137 and when the end 120 of the housing 121 is moved past openings 137, the space 136 will exhaust to atmosphere and bleed the pressure from cavities 83 and from the pressure line 104 to prevent and increase in the pressure in the object. The attachment 106 for line 104 to the valve in the object holds the valve open and the pressure in line 104 will be equal to or greater than the pressure in the object, when the relief valve 119 is not open. Attachment 106 is a standard fitting which utilizes a cam action on a plunger which opens the valve.

The operation of the air compressor is explained in connection with FIG. 10. During the pressure stroke, the pressure in line 104 to the object 105 will build up to a pressure peak which exceeds the pressure in the object. Pressurized air will move in the direction of arrows 140 to the accumulator 74 through restrictor 100 and to the object through line 104. Thus, the pressure in line 104 during the pressure stroke is not always a true value of the pressure in the object. In order to produce a representative object pressure in accumulator 74, the pressure peaks are damped out by the restrictor 100 to provide an average pressure. Also, on the suction stroke, the restrictor 100 communicates through line 104 with the object so that the accumulator receives the actual pressure in the object in the direction of arrow 141. Because of the presence of the restrictor 100, the accumulator does not receive the pressure peaks during the pressure stroke but does permit the object pressure to enter the accumulator during the suction stroke. Thus, the pressure acting against the valve 119 is representative of the true pressure in the object. It has been found that restrictor passage 100 can have dimensions of 0.020 inches square when the stroke volume of the compressor is about 5.5 cc and the volume in the accumulator 74 is about 9.0 cc. Since these volumes are of the same order of magnitude, it is possible to mount the accumulator directly on top of the valve housing without the accumulator being larger than the cylinder housing 33. Also, the regulator can be made an integral part of the accumulator with only the adjustable spring end extending beyond the cylinder housing. When the motor 15 is energized by a battery through a connection to the cigarette lighter, the present invention provides a compact, easily operable unit to inflate vehicle tires. Since the relief holes 137 in the regulator are not large enough to handle the pump output, the holes produce a continuous noise when the object pressure is exceeded and the operator will then turn off the compressor.

It is understood that the pressure stroke of piston 20 commences with air received from atmosphere and rises the air to a peak pressure greater than the pressure in the object during the completion of its stroke in order to pump air into the object. It is these peak pressures which are isolated from the accumulator by restrictor 100. From the dimensions previously given, the ratio of accumulator volume to cylinder displacement volume is about 1.64 but, of course, this ratio can be varied as long as proper leveling of pressure in the accumulator is obtained. Also, within the same criterion, the size of restrictor passage 100 can be varied from the 0.020 inches square dimension previously given.

As illustrated, the edge of the cap 134 contains progressive spaced indicia which cooperate with a mark on the extension 130 so that the object pressure to open the relief valve can be selected. It is understood that the invention can be used with a compressor having more than one cylinder since the restrictor 100 would average the pressure peaks from two or more cylinders out of phase with one another. Also, the pressure in the object would be sensed in the accumulator when the object pressure is greater than the pressure of the air being produced in the main line by the multiple cylinders. While the description refers to compressed air, any suitable gas can be utilized.

What is claimed is:

1. In a relief valve apparatus comprising a valve body having a centrally disclosed and longitudinally extending cavity therein, one end of said valve body having a first opening therein adapted to communicate with a source of air under pressure, a valve assembly disposed in said valve body adapted to control the flow of air from said source to said cavity, and biasing means disposed in said valve body adapted to exert a biasing pressure on said valve body tending to exert a longitudinally directed force on said valve assembly to thereby close said opening and prevent the flow of air from said source to said cavity, the improvement comprising:

a first pressure control means for pre-setting the degree of force exerted on said biasing means, said first pressure control means including a first adjustment means and a second adjustment means operatively associated with said first adjustment means, and a second pressure control means operatively associated with said first pressure control means for further controlling the degree of force exerted by said biasing means, whereby three methods of adjusting the force of said biasing means is provided.

2. A relief valve apparatus as recited in claim 1 having a second opening in said valve body enabling communication between said cavity and the outside of said valve body.

3. A relief valve apparatus as recited in claim 2 wherein said biasing means is a spring.

4. A relief valve apparatus as recited in claim 3 wherein said second pressure control means includes a cap member secured to the valve body.

5. A relief valve apparatus as recited in claim 4 wherein:

said valve body has threads on the outside surface of one end thereof;

said cap member has a cylindrical section therein with threads on the inside thereof adapted to receive the threaded end of said valve body;

whereby screwing of said cap onto said valve body causes compression of said spring to increase the biasing force on the valve assembly.

6. A relief valve apparatus as recited in claim 5 wherein:

said first adjustment means includes a plug member secured in a threaded opening in said cap member;

said second adjustment means comprising an extension with a channel thereon integral with said plug member, said channel adapted to receive and retain a length of said spring screwed therein, wherein the spring rate, and accordingly the force ultimately exerted by said biasing means, can be varied by increasing or decreasing the distance by which the spring is screwed onto said extension.

7. A relief valve apparatus as recited in claim 6 wherein:

the second opening in said valve member is disposed along the length thereof; and said valve member has a third opening disposed along the length thereof at a location substantially opposite the second opening.

8. A relief valve apparatus as recited in claim 7 wherein:

the biasing force tending to close said first opening is preset by adjusting said first and second control means; and presentation of a pressure at said source in excess of the preset biasing force causes movement of said valve assembly away from said opening to enable passage of air from said source to the cavity and outward therefrom through the second and third openings.

9. A relief valve assembly apparatus as recited in claim 8 wherein passage of air through said second and third openings creates an audible signal.

10. A relief valve apparatus as set forth in claim 1, wherein said first adjustment means comprises a plug member threadedly secured to said valve body and connected to said biasing means, whereby screwing said plug member into said valve body increases the degree of force on said biasing means.

11. A relief valve apparatus as set forth in claim 10 wherein said second adjustment means comprises an extension having channels therein adapted to receive and retain a portion of said biasing means, whereby the degree of force exerted by said biasing means is varied by varying the portion of said biasing means retained in the channel on said extension being integral with said plug member.

12. A relief valve apparatus as recited in claim 11 wherein said biasing means is a spring.

13. A relief valve apparatus as set forth in claim 1 wherein said second adjustment means comprises an extension having channels therein adapted to receive and retain a portion of said biasing means, whereby the degree of force exerted by said biasing means is varied by varying the portion of said biasing means retained in the channel on said extension.

* * * * *